US006455995B1

(12) United States Patent
Jang et al.

(10) Patent No.: US 6,455,995 B1
(45) Date of Patent: Sep. 24, 2002

(54) ONE-PIN DYNAMIC ELECTRON GUN FOR A CATHODE RAY TUBE

(75) Inventors: Hyoung-wook Jang, Suwon; Jeong-nam Kim, Gunpo; Hak-cheol Yang, Suwon, all of (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/444,502

(22) Filed: Nov. 22, 1999

(30) Foreign Application Priority Data

Nov. 23, 1998 (KR) ..... 1998-50230

(51) Int. Cl.[7] ..... H01J 29/48; H01J 29/51

(52) U.S. Cl. ..... 313/414; 313/412; 315/368.15

(58) Field of Search ..... 313/414, 412, 313/409, 411, 456, 451, 415, 470, 413, 417; 315/3, 15, 382.1, 382, 368.15

(56) References Cited

U.S. PATENT DOCUMENTS

| | | | | | |
|---|---|---|---|---|---|
| 4,032,811 | A | * | 6/1977 | Schwartz et al. | 313/417 |
| 4,181,870 | A | * | 1/1980 | Stevens | 313/414 |
| 5,250,875 | A | * | 10/1993 | Kho | 313/414 |
| 5,895,303 | A | * | 4/1999 | Kimura et al. | 445/34 |
| 2001/0050526 | A1 | * | 12/2001 | Miyamoto et al. | 313/417 |

* cited by examiner

*Primary Examiner*—Ashtok Patel
*Assistant Examiner*—Karabi Guharay
(74) *Attorney, Agent, or Firm*—Leydig, Voit & Mayer, Ltd.

(57) ABSTRACT

A solid dielectric material is installed between the second focus electrode and third focus electrode in a one-pin dynamic electron gun assembly in order to increase capacitance between the two electrodes. The increased capacitance between the two electrodes reduces the voltage Vg between the two electrodes and increases the effective voltage Vd (eff) between the third focus electrode and the fourth focus electrode since Vd=Vg+Vd (eff).

4 Claims, 4 Drawing Sheets

ONE-PIN DYNAMIC ELECTRON GUN FOR A CATHODE RAY TUBE

BACKGROUND OF THE INVENTION

1. Field of the Invention

The present invention relates to a one-pin dynamic electron gun for a cathode ray tube having an improved voltage efficiency applied to its dynamic electrode.

2. Description of the Related Art

As a way to reduce power consumption of a cathode ray tube, a neck having a smaller diameter has been used and, as a result, there is not much room to install a stem pin, which required a one-pin type dynamic electron gun.

FIG. 1 illustrates a conventional one-pin dynamic electron gun. FIG. 2 shows a schematic diagram of the electron gun shown in FIG. 1. It is composed of a cathode 11 emitting electrons and a plurality of electrodes G to focus and accelerate the emitted electrons. G1, G2, G3, G4, G5–1, G5–2 and G6 are a control electrode, screen electrode, first focus electrode, second focus electrode, third focus electrode, fourth focus electrode and anode electrode, respectively. Ec1, Ec2, Vf+Vd, and Eb represent voltages applied to the corresponding electrodes.

In the above electron gun, Vd is supplied from an external voltage source and the effective voltage Vd (eff) between the third focus electrode G5–1 and the fourth focus electrode G5–2 is equal to Vd−Vg, where Vg has a gain and phase difference $\phi$ with respect to Vd according to the following formula 1:

$$Vg = Vd\sqrt{\frac{1+(\omega C1R1)^2}{1+\omega^2(C1+C2)^2R1^2}} \qquad \text{[Formula 1]}$$

$$\phi = \tan^{-1}\frac{-\omega C2R1}{1+\omega^2C1(C1+C2)R1^2}$$

where C1 represents capacitance between the third focus electrode G5–1 and the fourth focus electrode G5–2 due to the distance between them, and C2 represents capacitance between the second focus electrode G4 and the third focus electrode G5–1 due to the distance between them and has a similar value to C1. Assuming C1=C2, for a horizontal deflection signal of 64 KHz in frequency, Vg is equal to one half of Vd and the effective dynamic voltage Vd (eff)=Vd−Vd/2=Vd/2. This implies that power efficiency of Vd delivered between the third and fourth electrodes is only 50%. And there is almost no phase difference, i.e., 0.14 degree. Although a dynamic voltage according to the vertical deflection signal is currently not supplied from the external source, if it is to be in the future, Vg will be 0.95 Vd for a 60 Hz vertical deflection signal, meaning that the power efficiency is only 5%, resulting in the electrodes failing to function as a quadrupole lens.

SUMMARY OF THE INVENTION

To solve the above problems, it is an objective of the present invention to provide a first objective of the present invention is to maximize power efficiency of a voltage signal applied to a dynamic electrode of an electron gun.

A dielectric is installed between the second focus electrode and third focus electrode in a one-pin dynamic electron gun assembly in order to increase capacitance between the two electrodes. The increased capacitance between the two electrodes reduces the voltage Vg therebetween and increases the effective voltage Vd (eff) between the third focus electrode and fourth electrode since Vd (eff) =Vd−Vg.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 3:
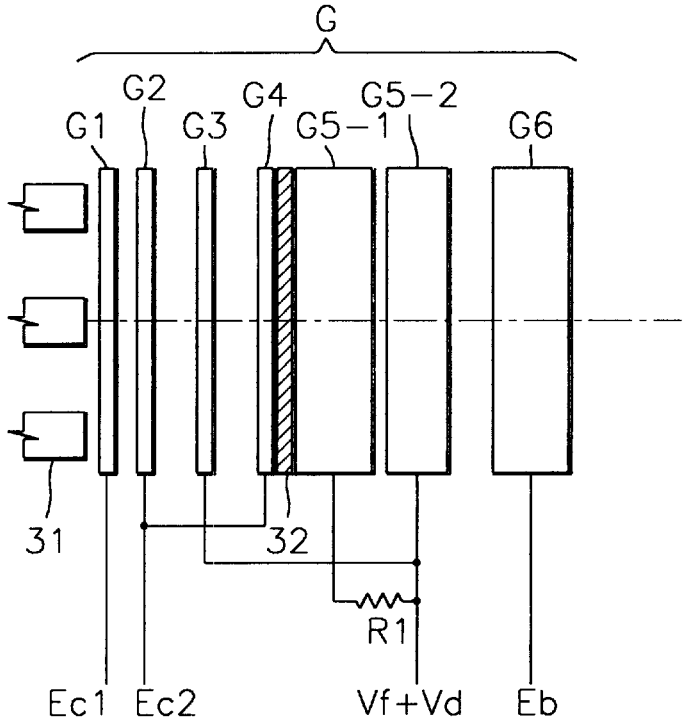
FIG. 3 shows a one-pin dynamic electron gun according to the present invention.
Figure 4:
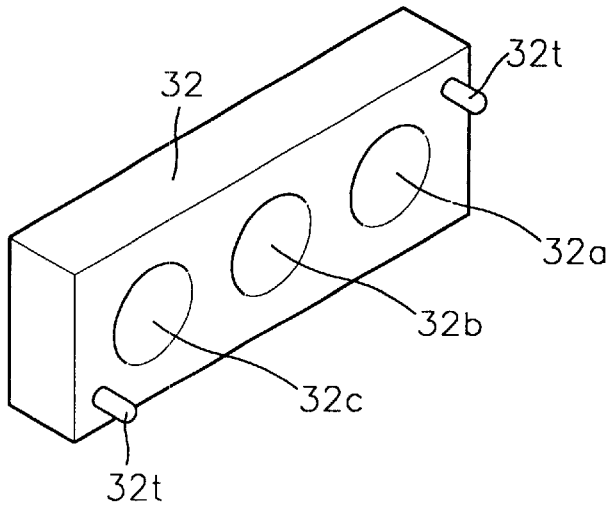
FIG. 4 shows a dielectric to be installed between a second focus electrode and a third focus electrode.

FIG. 3 shows an embodiment of the present invention. Like a conventional one-pin dynamic electron gun, the present invention comprises a cathode 31 emitting electrons when heated by a heater (not shown) and a plurality of electrodes G to focus and accelerate the emitted electrons. Specifically G1, G2, G3, G4, G5–1, G5–2 and G6 are a control electrode, screen electrode, first focus electrode, second focus electrode, third focus electrode, fourth focus electrode, and anode electrode, respectively. Ec1, Ec2, Vf+Vd and Eb represent voltages, applied to the corresponding electrodes. However, the present invention differs from the prior art in that there is provided a solid dielectric 32 between the second focus electrode G4 and the third focus electrode G5–1. As shown in FIG. 4, the solid dielectric 32 is preferably a thin rectangular plate with electron beam-passing holes 32*a*, 32*b*, 32*c* and protrusions 32*t* for secure coupling with the second electrode which, in turn, has small recesses where the protrusions are to be inserted.

The solid dielectric 32 used in the present invention is preferably a ceramic which is resistant to high temperature and has a dielectric constant more than 10 times that of free space. Less preferably, glass having 7–8 times the dielectric constant of free space may be used.

Figure 1:
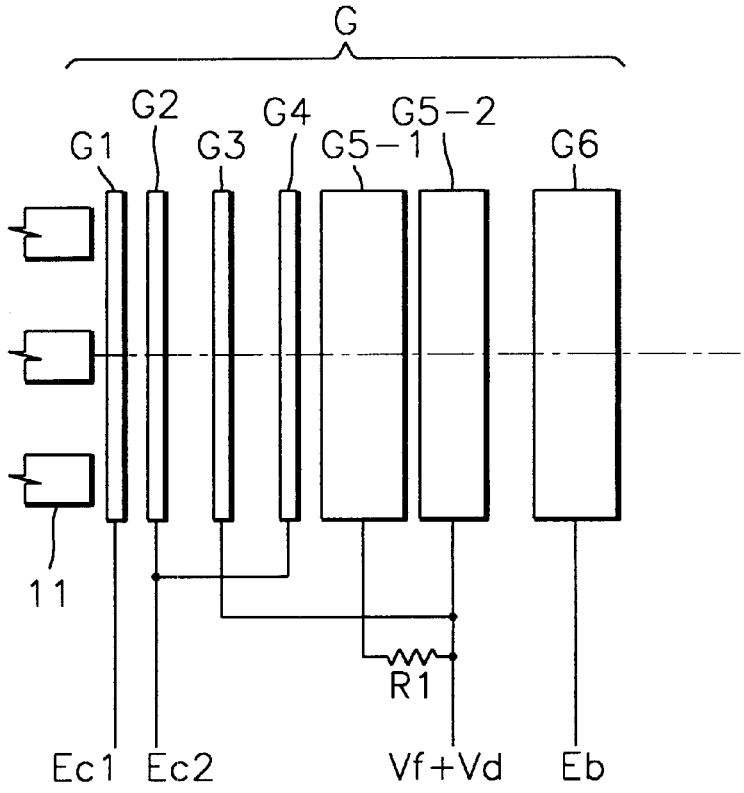
FIG.1 (PRIOR ART)
FIG. 1 shows a conventional one-pin dynamic electron gun.
Figure 2:
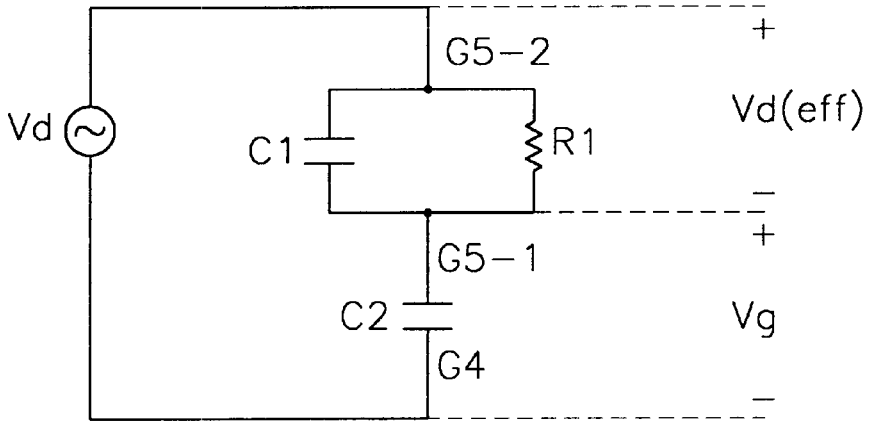
FIG. 2 (PRIOR ART)
FIG. 2 is a schematic diagram of the conventional one-pin dynamic electron gun shown in FIG. 1.

Referring to Formula 1 and the schematic diagram of FIG. 2, it can be inferred that the lower level of Vg translates into increased power efficiency of Vd. For example, if the ratio of C2 to C1 is 10, then Vg becomes 0.1 Vd for a horizontal deflection frequency of 64 kHz. As a result, the effective dynamic voltage is 0.9 Vd, meaning that the power efficiency is 90%. Here the phase difference is very small on the order of 0.25 degree.

As is well known in the art, capacitance is defined as follows:

$$C = \varepsilon \frac{V}{d}$$

where V, d and ∈ are a voltage, a distance and a dielectric constant between two polarities, respectively. With this definition of capacitance in mind, only ∈ or/and d can be adjusted in order to increase the capacitance between the two electrodes since V, the voltage of an external power source, is already set and thus not variable. One may reduce d to increase the capacitance between two electrodes. In this case, however, because the distance between the electrodes should be one tenth of the conventional distance, this option has a drawback of possible current leakage and more complicated manufacturing. The remaining option is to increase ∈, the dielectric constant between the two electrodes, for instance, to 10 times that of free space. The present invention utilizes this alternative for achieving maximum power efficiency of dynamic voltage signals. As a dielectric material, glass or ceramic may be used since these materials are resistant to the high temperature required in the manufacturing process of an electron gun assembly.

Figure 5:
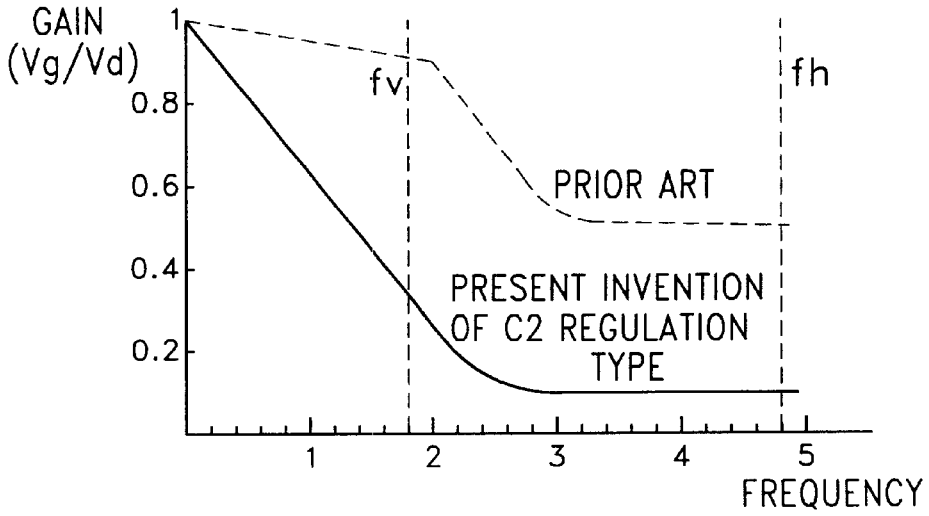
FIG. 5 is a graph illustrating the ratio of Vg to Vd versus the frequency of the dynamic voltage signal.
Figure 6:
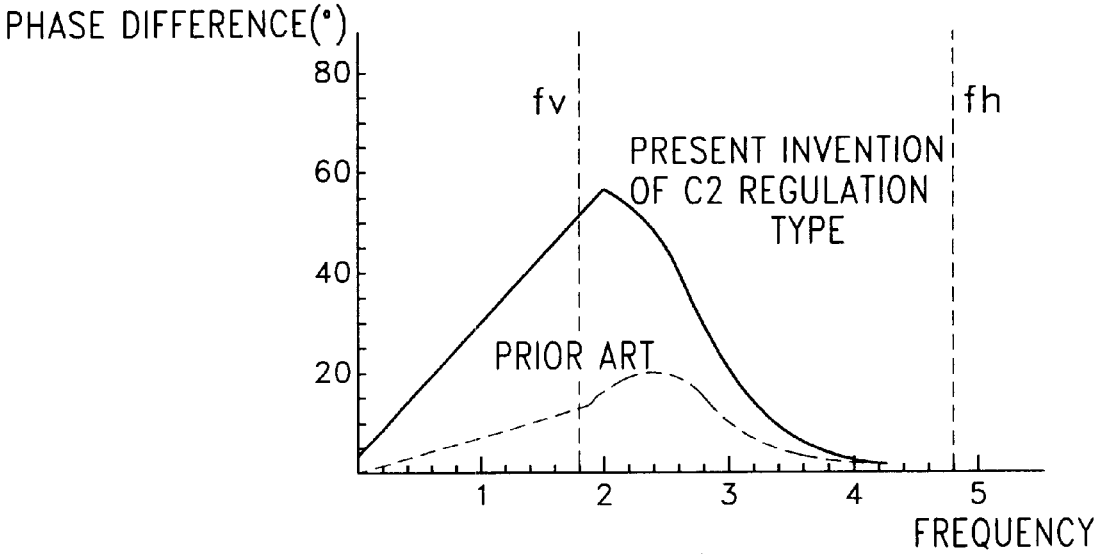
FIG. 6 is a graph illustrating the phase difference between Vg and Vd versus the frequency of the dynamic voltage signal.

FIGS. 5 and 6 illustrate the gain and phase difference between Vg and Vd with respect to the frequency of a dynamic voltage signal, respectively. In FIGS. 5 and 6, fv is the frequency of the vertical deflection signal and fh is the frequency of the horizontal deflection signal.

As mentioned above in the Background of the Invention section, because Vg would be 0.95 Vd for a vertical deflection signal having a frequency of 60 Hz in the prior art, it can not dynamically deflect electron beams. In the present invention where the capacitance between the second and third electrodes is increased, the power efficiency increases to 0.4 Vd but has a drawback of an undesirably large phase difference causing non-uniform focusing of the electron beam in the vertical direction. Therefore, it is required that the phase difference be reduced. The reduction of the phase difference is made possible by increasing the resistance R1 of FIG. 2.

Figure 7:
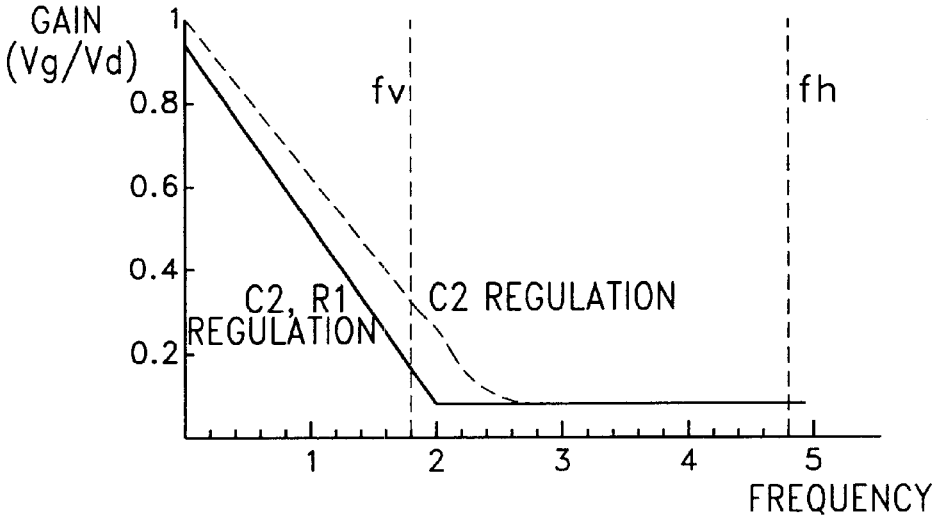
FIG. 7 is a graph illustrating the ratio of Vg to Vd versus the frequency of the dynamic voltage signal.
Figure 8:
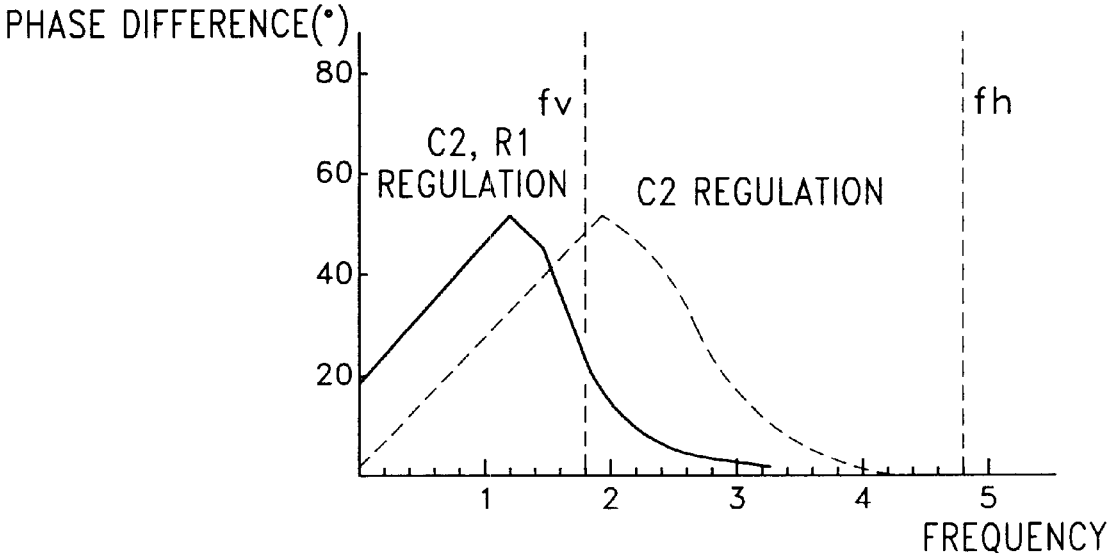
FIG. 8 is a graph illustrating the phase difference between Vg and Vd versus the frequency of the dynamic voltage signal.

Referring to FIG. 8, when the resistance is increased tenfold, the phase difference is reduced to about 25 degrees for the vertical deflection signal having a frequency fv, about one half of the phase difference when C2 alone is increased. Though there still remains vertical non-uniform focusing, it is hardly noticeable and thus can be ignored. Better yet, as shown in FIG. 7, by adjusting both C2 and R1, the power efficiency of the vertical deflection signal having a frequency fv can be boosted up to 90%.

What is claimed is:

1. An electron gun for a cathode ray tube comprising:

a cathode emitting electrons;

a control electrode;

a screen electrode;

a plurality of focus electrodes;

an anode electrode; and a plate of a solid dielectric material having three electron beam passing holes and disposed between two of said plurality of focus electrodes.

2. The electron gun as claimed in claim 1, wherein said solid dielectric material comprises a ceramic.

3. The electron gun as claimed in claim 1, wherein said solid dielectric material comprises a glass.

4. The electron gun as claimed in claim 1, wherein said plate has a plurality of protrusions on at least one of its surfaces.

* * * * *